US007934718B2

(12) United States Patent
Clark

(10) Patent No.: US 7,934,718 B2
(45) Date of Patent: May 3, 2011

(54) SHEET FEEDING OF FASTER RATE PRINTING SYSTEMS WITH PLURAL SLOWER RATE SHEET FEEDERS

(75) Inventor: Robert A. Clark, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 1490 days.

(21) Appl. No.: 11/088,496

(22) Filed: Mar. 24, 2005

(65) Prior Publication Data

US 2006/0214352 A1 Sep. 28, 2006

(51) Int. Cl.
*B65H 3/44* (2006.01)

(52) U.S. Cl. ..... 271/9.04; 271/9.13

(58) Field of Classification Search ..... 271/9.04, 271/9.13

See application file for complete search history.

(56) References Cited

U.S. PATENT DOCUMENTS

| | | | | | |
|---|---|---|---|---|---|
| 1,935,051 | A | * | 11/1933 | Harrold | 101/174 |
| 2,255,777 | A | * | 9/1941 | Sloper | 270/58.04 |
| 2,352,088 | A | * | 6/1944 | Evans | 271/9.07 |
| 3,335,859 | A | | 8/1967 | Borchert et al. | |
| 3,523,685 | A | * | 8/1970 | Ehlscheid | 271/9.01 |
| 3,622,238 | A | * | 11/1971 | Alman et al. | 355/50 |
| 3,753,560 | A | * | 8/1973 | Kapral et al. | 271/9.11 |
| 3,758,103 | A | * | 9/1973 | Gianese | 271/4.1 |
| 4,132,398 | A | * | 1/1979 | Erdmann et al. | 271/9.04 |
| 4,211,398 | A | * | 7/1980 | Bishop | 271/9.01 |
| 4,229,101 | A | | 10/1980 | Hamlin et al. | |
| 4,451,028 | A | | 5/1984 | Holmes et al. | |
| 4,508,447 | A | * | 4/1985 | Doery | 399/374 |
| 4,579,446 | A | | 4/1986 | Fujimoto | |
| 4,587,532 | A | | 5/1986 | Asano | |
| 4,618,135 | A | * | 10/1986 | Greiner et al. | 271/9.04 |
| 4,688,782 | A | * | 8/1987 | Browne | 271/9.07 |
| 4,789,258 | A | * | 12/1988 | Gomoll et al. | 400/605 |
| 4,918,489 | A | * | 4/1990 | Inage et al. | 399/391 |

(Continued)

FOREIGN PATENT DOCUMENTS

JP 03073731 A * 3/1991

OTHER PUBLICATIONS

U.S. Appl. No. 11/049,190, filed Feb. 2, 2005 by Barry P. Mandel at al, entitled "A System of Opposing Alternate Higher Speed Sheet Feeding From the Same Sheet Stack".

(Continued)

*Primary Examiner* — Stefanos Karmis
*Assistant Examiner* — Michael C McCullough
(74) *Attorney, Agent, or Firm* — Ronald E. Prass, Jr.; Prass LLP

(57) ABSTRACT

A printing system with a pre-determined printing rate, in which a modular print media sheets feeding system feeds unprinted sheets to the printing system from at least two separate sheet separator/feeders and sheet stacks under the control of a programmed sheet feeding algorithm which alternately feeds the sheets into at least two separate fed sheet streams at a sheet feeding cycle time for each separator/feeder of approximately one-half or less of the printing system printing rate and with sheet feeding commands such that the separate sheet separator/feeders feed their respective sheets into their respective fed sheet streams at programmed times which allow the fed sheet streams to interleave into a single fed sheet stream at a sheet merging position at the full pre-determined printing rate of the printing system before being fed to the printing system.

1 Claim, 2 Drawing Sheets

U.S. PATENT DOCUMENTS

Figure 1:
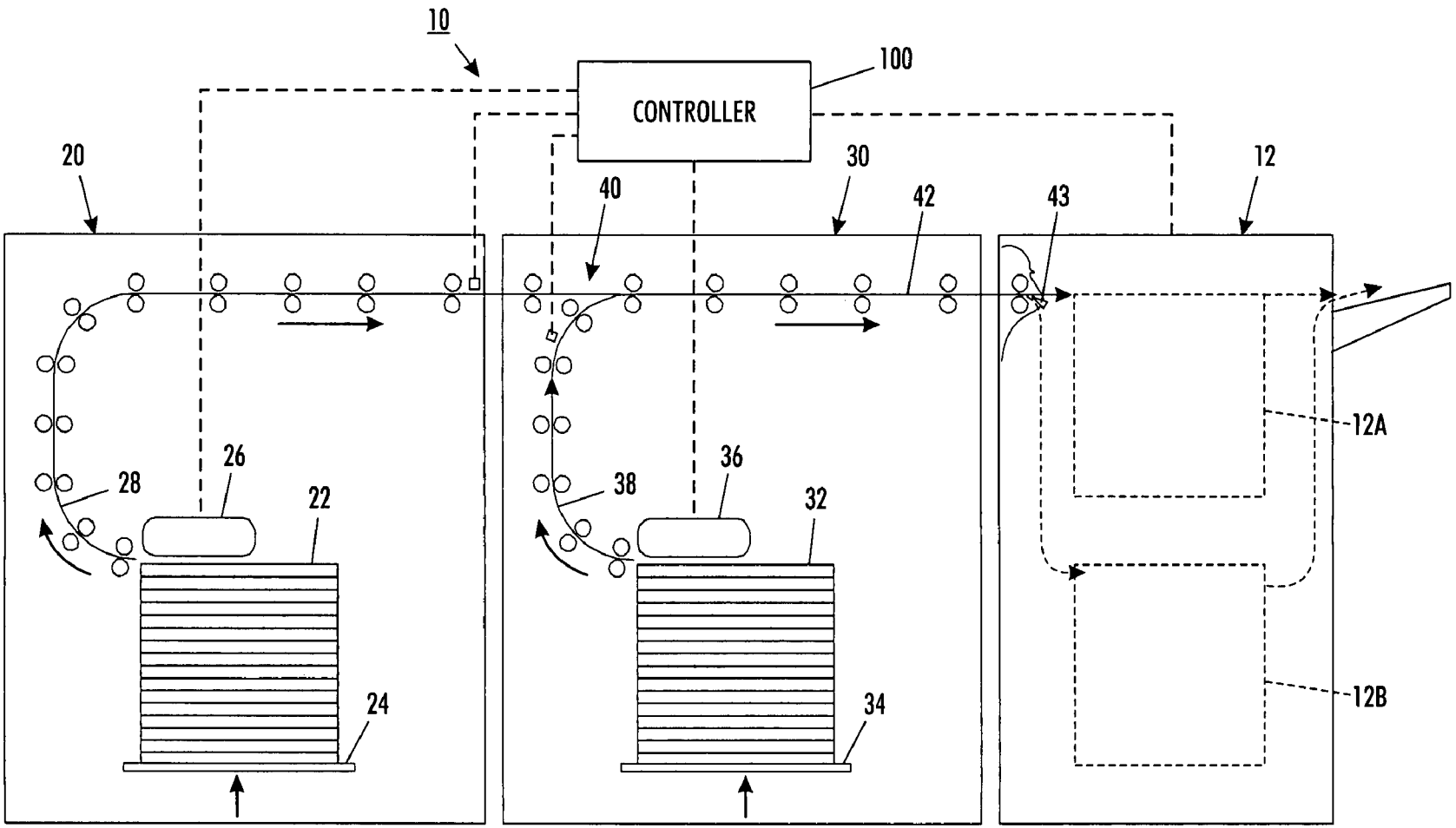

| | | | | | |
|---|---|---|---|---|---|
| 4,966,357 | A | * | 10/1990 | Burger | 271/9.12 |
| 5,072,924 | A | * | 12/1991 | Sugiyama | 271/110 |
| 5,208,640 | A | | 5/1993 | Horie et al. | |
| 5,221,951 | A | | 6/1993 | Sakamoto | |
| 5,294,966 | A | * | 3/1994 | Shiokawa | 399/388 |
| 5,327,207 | A | | 7/1994 | Otake et al. | |
| 5,421,699 | A | * | 6/1995 | Guiles et al. | 414/788 |
| 5,528,353 | A | * | 6/1996 | Ushio et al. | 399/364 |
| 5,568,246 | A | | 10/1996 | Keller et al. | |
| 5,570,172 | A | * | 10/1996 | Acquaviva | 399/403 |
| 5,596,416 | A | | 1/1997 | Barry et al. | |
| 5,778,783 | A | | 7/1998 | Compera et al. | |
| 6,123,329 | A | * | 9/2000 | Sato et al. | 271/9.01 |
| 6,125,248 | A | | 9/2000 | Moser | |
| 6,182,961 | B1 | | 2/2001 | Wenth, Jr. | |
| 6,264,188 | B1 | | 7/2001 | Taylor et al. | |
| 6,352,255 | B1 | | 3/2002 | Taylor | |
| 6,398,207 | B1 | | 6/2002 | Taylor et al. | |
| 6,398,208 | B1 | | 6/2002 | Yang et al. | |
| 6,597,889 | B2 | | 7/2003 | Johnson et al. | |
| 6,608,988 | B2 | | 8/2003 | Conrow | |
| 6,698,746 | B2 | * | 3/2004 | Buck et al. | 271/9.04 |
| 6,785,478 | B2 | * | 8/2004 | Takahashi et al. | 399/16 |
| 6,975,413 | B1 | * | 12/2005 | Sasaoka | 358/1.12 |
| 6,976,672 | B2 | * | 12/2005 | Kawata | 271/9.11 |
| 2004/0247353 | A1 | | 12/2004 | Antinora | |
| 2004/0256786 | A1 | * | 12/2004 | Honegger | 271/9.13 |

OTHER PUBLICATIONS

U.S. Appl. No. 10/761,522, filed Jan. 21, 2004 by Robert Lofthus et al, entitled "High Print Rate Merging and finishing system for Parallel Printing".

"Xerox Disclosure Journal" publication of Nov.-Dec. 1991, vol. 16, No. 6, pp. 381-383, by Paul F. Morgan, entitled "Integration of black Only and Color Printers".

* cited by examiner

SHEET FEEDING OF FASTER RATE PRINTING SYSTEMS WITH PLURAL SLOWER RATE SHEET FEEDERS

Cross-reference is made to a copending commonly assigned U.S. application Ser. No. 11/049,190, filed Feb. 2, 2005, by Barry P. Mandel et al, entitled "A System of Opposing Alternate Higher Speed Sheet Feeding From The Same Sheet Stack,".

Also cross-referenced, and incorporated by reference, is copending and commonly owned U.S. application Ser. No. 10/455,656 filed Jun. 5, 2003 by Terrance J. Antinora, entitled "Printer With Integral Automatic Pre-Printed Sheets Insertion System," USPTO published Dec. 9, 2004 as Publication No. 20040247353.

Also cross-referenced, and incorporated by reference, is copending commonly owned U.S. application Ser. No. 10/761,522 filed Jan. 21, 2004 by Robert Lofthus, Barry Mandel, Steve Moore and Martin Krucinski, entitled "High Print Rate Merging and Finishing System for Parallel Printing," projected to be published Jul. 31, 2005 as Publication No. 20050158094.

Disclosed in the embodiments herein is a system for alternately feeding unprinted print media sheets, preferably of the same size and type from plural different sheet stacks or trays, with plural separate sheet feeders, and alternately merging the output paths of the sheets being fed from these plural sheet feeders into a single sequential stream of print media sheets having plural times the number print media sheets per minute (PPM) rate of each of those individual sheet feeders, and feeding this combined (higher PPM rate) print media steam to a printing system which may have the PPM printing rate of the merged sequential input stream of print media sheets, for printing at a much faster printing rate than the sheet feeding rate of any of the individual sheet feeders.

It can be difficult to reliably feed print media sheets from the same stack, with the same sheet feeder, to keep up with the print media sheet requirements for the full printing rate of an associated higher speed printer. This often requires a more sophisticated and expensive sheet separator/feeder, such as the pneumatic types cited by way of background herein. That kind of sheet separator/feeder can cost more than twice as much as more common, and much less costly, friction retard feeders, and may well require additional space, ducting, power consumption and noise shielding for their pneumatic systems. Even active or semi-active roll friction sheet separator/feeders, even with air stack fluffing assistance, have practical limitations in extending their utility for highly reliable (low sheet misfeed and low sheet double-feed rates) high speed sheet separation and feeding for such higher printing productivity rates. For example, feeding sheets from the same stack with a single conventional low cost friction retard type sheet feeder operating at more than approximately 110 pages per minute is believed to normally risk increasing sheet feeding reliability problems, such as miss-feeds, multiple feeds, skipped printing pitches and/or printer jam clearance stoppages, and thus risk reduced customer satisfaction. (However, this is not to imply any specific speed limitation on the utility or application of disclosed systems.) But even slower printing systems can benefit in sheet feeding reliability by approximately at least doubling the acquisition time available for sheet separation and take-away for each sheet feeder. That is, longer available top sheet acquisition times for sheet nudging, separating, accelerating out, etc., can provide for more reliable sheet separation and feeding from a sheet stack.

For faster printing rates, an often desirable feature, the individual print media sheets must, of course, be fed at a correspondingly faster rate at the proper times to be printed. Reducing the time required for reliable separation of an individual print media sheet from the top of a stack of print media sheets and for feeding those separated sheets from the stack into a sheet output path to a printer at the desired times may be referred to as reducing "sheet acquisition times." Reduced sheet acquisition times tends to reduce reliable separating and feeding of the individual print media sheets from the stack, and thus often requires more complex and costly sheet feeders. Sheet separations can be difficult, especially for coated papers or transparencies. For paper print media it is relatively common, for example for cut stacks of paper sheets to have what are called "edge weld" fiber adhesions to one another at the sheet edges.

With ganged or other integrated plural print engine printing systems, such as those referenced herein, even lower speed print engines may require higher sheet feeding rates for feeding sheets to the integrated plural print engine system fast enough for full productivity printing with the plural print engines printing simultaneously. That is, printing systems for increasing printing rates by combining plural print engines, which can print alternating or opposing pages of a print job, as in the exemplary patents cited herein, can create additional sheet feeding difficulties.

Some of the disclosed features of the disclosed embodiments can include, for example, lower cost and/or more reliable sheet feeding by enabling sheet feeding with lower cost sheet feeders that can desirably individually have longer (slower) sheet separation and total sheet acquisition times yet feed consistent print media from the same sheet feed stack in the same sheet feed tray to the same or different print engines to keep up with the maximum printing rate of the overall printing system.

In the disclosed embodiments two or more separate sheet feeders can feed sheets alternately without interfering with one another, even though their respective sheet feeds can be slower and largely or substantially overlapping in time.

Although particularly attractive for said disclosed or other integrated plural print engine printing systems, it will be apparent to those skilled in this art that the disclosed nearly doubled sheet feed head acquisition time allowed for the same output sheet feeding rate, and other advantages, is also desirable for various single print engine printing systems.

The following U.S. patents are noted by way of background and for optional partial incorporation by reference as to the subject embodiments. Particularly noted is the single stack dual sheet feeders systems of Johnson, et al (Hewlett-Packard Development Company, L.P.) U.S. Pat. No. 6,597,889 B2 issued Jul. 22, 2003, and published Jan. 30, 2003 as Pub. No. 2003/0021619 A1. Also noted is Otake, et al (Sanyo Electric Co., Ltd.) U.S. Pat. No. 5,327,207 issued Jul. 5, 1994; Sakamoto (Sanyo Electric Co., Ltd.) U.S. Pat. No. 5,221,951 issued Jun. 22, 1993; Holmes et al (Xerox Corp.) U.S. Pat. No. 4,451,028 issued May 29, 1984; Gerhard Erich Borchert et al (Bundesdruckeriei Berlin) U.S. Pat. No. 3,335,859 issued Aug. 15, 1967; and Compera et al (Heidelberger Druckmaschinen) U.S. Pat. No. 5,778,783 issued Jul. 14, 1998.

Also noted for background and incorporation by reference (as appropriate) as to plural print engine printing systems are some examples of what have been variously called "tandem engine" printers, "cluster printing," "output merger" systems, etc. For example, Xerox Corp. U.S. Pat. No. 5,568,246 issued Oct. 22, 1996 by Paul D. Keller, et al; U.S. Pat. No. 6,608,988 B2 issued Aug. 19, 2003 by Brian Conrow and previously USPTO published on Apr. 24, 2003 as Pub. No. 2003/0077095 A1 entitled "Constant Inverter Speed Timing Method and Apparatus for Duplex Sheets in A Tandem Printer;" Canon Corp. U.S. Pat. No. 4,587,532; T/R Systems U.S. Pat. No. 5,596,416 by Barry et al; Canon Corp. U.S. Pat. No. 4,579,446 by Fujimoto; Fuji Xerox U.S. Pat. No. 5,208,640; Xerox U.S. Pat. No. 6,125,248 by Rabin Moser on parallel path printing; and a "Xerox Disclosure Journal" publication of November-December 1991, Vol. 16, No. 6, pp. 381-383 by Paul F. Morgan entitled "Integration Of Black Only And Color Printers." Also, the above cross-referenced co-pending and commonly owned "TIPP" U.S. patent application Ser. No. 10/761,522 filed Jan. 21, 2004.

Various types of exemplary print media sheet feeders, such as those with retard sheet feeding nips and/or vacuum sheet feeding heads, and nudger wheels and/or pneumatic "air knife" or other sheet separation and sheet feeding assistance systems therefore, are well known in the art and need not be re-described herein. Some incorporated by reference examples of modern retard feeders include U.S. Pat. No. 6,182,961 issued Feb. 6, 2001 to Stephen J. Wenthe Jr. (Xerox Corp.) on an active retard roll sheet separator/feeder, along with numerous other prior retard and other feeder patents cited therein. Some incorporated by reference examples of a modern type of more costly and complex high speed sheet feeder with, variously, skirted vacuum sheet corrugating sheet acquisition heads with air knives or puffers assistance and a shuttle movement of the feed head, include one or more of Xerox Corp. U.S. Pat. Nos. 6,398,207; 6,398,208; 6,352,255; 6,398,207; and 6,264,188, and other patents cited therein.

Further by way of background, the concept of alternate sheet feeding from two different sheet trays into a single output stream is disclosed in Xerox Corp. U.S. Pat. No. 4,229,101 issued Oct. 21, 1980 to Hamlin et al for duplex to simplex copying from a recirculating set of original documents, as described in Col. 18, lines 25-40, and Col. 21, lines 16 to Col. 22 (end). This concept was used in some prior Xerox Corp. xerographic copier products. However, this concept is for storing and then merging already printed sheets into a stream of other sheets being printed. This patent does not specifically indicate if the feeders are feeding at the normal process [print engine] speed {PPM rate} into a merged output stream at the normal process [print engine] speed, or not, but in any case the merged output stream is not clean sheets being fed to a higher speed print engine for printing.

A specific feature of the specific embodiments disclosed herein is to provide a printing system having a pre-determined printing rate and an operably integrated unprinted print media sheets feeding system for said printing system, said operably integrated unprinted print media sheets feeding system feeding said unprinted print media sheets to said printing system at said pre-determined printing rate of said printing system from at least two separate sheet separator/feeders feeding from at least two separate stacks of said unprinted print media sheets, which at least two separate sheet separator/feeders are controlled by a system controller programmed with a sheet feeding algorithm to alternately feed said unprinted print media sheets to said printing system from said at least two separate sheet separator/feeders into at least two separate fed sheet streams at a sheet feeding rate of approximately one-half or less of said printing system printing rate from each of said at least two separate sheet separator/feeders, wherein a sheet merging position is provided for merging said at least two separate fed sheet streams, and wherein said system controller sheet feeding algorithm sends sheet feeding commands to said at least two or more sheet separator/feeders at programmed times such that said at least two separate sheet separator/feeders feed sheets into said respective at least two fed sheet streams at times which allow said at least two fed sheet streams to interleave into a single fed sheet stream at said sheet merging position at said pre-determined printing rate of said printing system.

Further specific features disclosed in the embodiments herein, individually or in combination, include those wherein said operably integrated print media sheets feeding system comprises at least two said separate sheet separator/feeders in at least two separate modules; and/or wherein said operably integrated print media sheets feeding system comprises a single module containing said least two said separate sheet separator/feeders and said respective at least two fed sheet streams; and/or wherein said sheet merging position is between said least two said separate sheet separator/feeders and said printing system; and/or a printing method for printing unprinted print media sheets fed from a print media sheets feeding system to a printing system having a pre-determined printing rate, said print media sheets feeding system feeding said unprinted print media sheets to said printing system at said pre-determined printing rate of said printing system from at least two separate sheet separator/feeders feeding sheets from at least two separate stacks of said unprinted print media sheets into at least two separate fed sheet streams, controlling said at least two separate sheet separator/feeders to alternately feed said print media sheets from said at least two separate sheet separator/feeders into said respective at least two separate fed sheet streams at a sheet feeding rate of approximately one-half or less of said printing system printing rate from each of said at least two separate sheet separator/feeders, and controlling said at least two or more sheet separator/feeders to feed sheets into said respective at least two fed sheet streams at times which allow said at least two fed sheet streams to merge interleaved into a single fed sheet stream at a sheet merging position at said pre-determined printing rate; and/or wherein said at least two said separate sheet separator/feeders are in at least two separate modules; and/or wherein said print media sheets feeding system comprises a single module containing said least two said separate sheet separator/feeders and said respective at least two fed sheet streams; and/or wherein said sheet merging position is between said least two said at least two fed sheet streams and said printing system.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

The terms reproduction machine or apparatus, printer or printing system as used herein broadly encompasses various different printers, copiers or multifunction machines or systems, xerographic or otherwise, including plural tandem or ganged printers, unless otherwise defined in a claim. The term "sheet" herein refers to a usually flimsy physical sheet of paper, plastic, or other suitable physical substrate for images, whether precut or web fed. A "print job" is normally a set of related print media sheets, usually one or more collated copy sets copied from a set of original document sheets or electronic document page images, from a particular user, or otherwise related. Various otherwise conventional or existing sheet trays, drawers or cassettes may be may be generically encompassed herein by the terms tray or trays.

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuations, or component drive systems illustrated herein are merely exemplary, and that the same motions and functions can be provided by many other known or readily available alternatives. All cited references, and their references, are incorporated by reference herein where appropriate for teachings of additional or alternative details, features, and/or technical background. What is well known to those skilled in the art need not be described herein.

DETAILED DESCRIPTION OF THE DRAWINGS AND PREFERRED EMBODIMENTS

Figure 2:
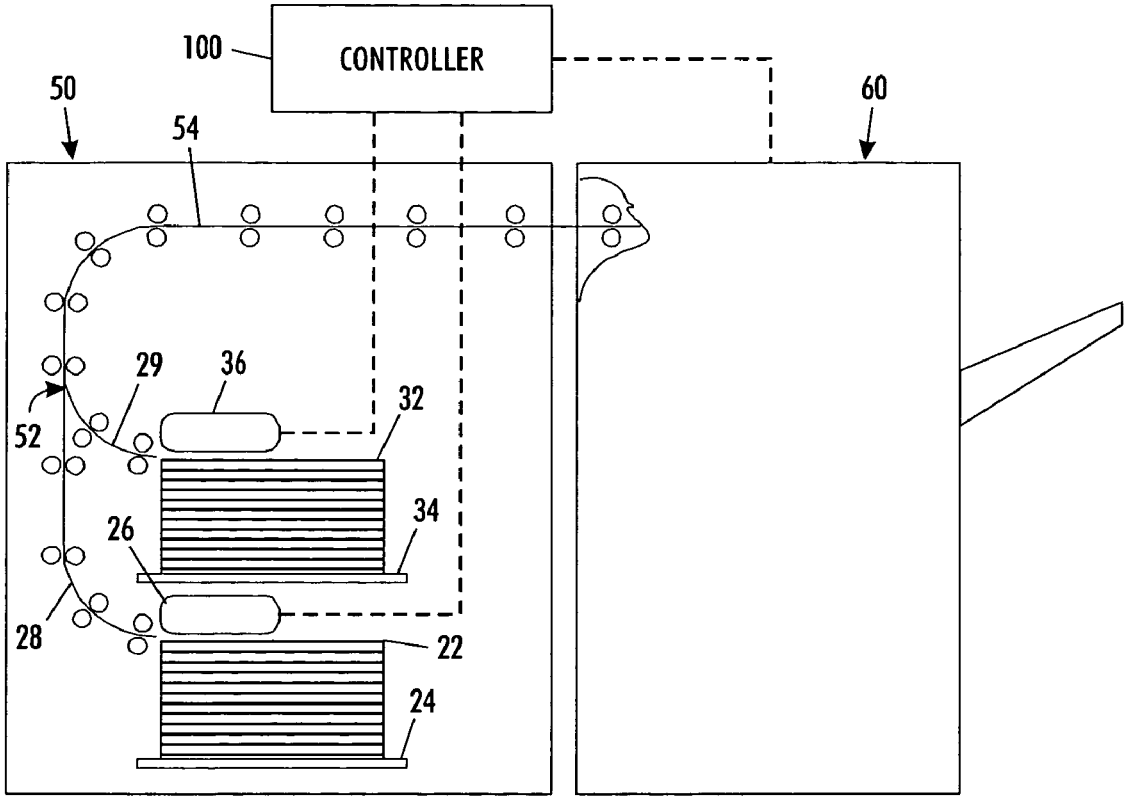

Various of the above-mentioned and further features and advantages will be apparent to those skilled in the art from the specific apparatus and its operation or methods described in the examples below, and the claims. They may be better understood from this description of these exemplary specific embodiments, including the drawing figures, wherein:

FIG. 1 is a schematic plan view of a reproduction system with a printing system being fed print media sheets by two sheet feeding modular units, each with a separate lower rate sheet feeder feeding sheets from separate sheet stacks into a higher rate merged sheet feeding path to the printing system, which as shown in phantom may comprise plural integrated printers printing in parallel for a higher combined printing rate; and FIG. 2 is similar to FIG. 1 but with a single sheet feeding modular unit with two sheet trays and two sheet feeders providing the higher sheet feeding rate as a merged output to a printer.

Describing now in further detail these exemplary embodiments, there is shown in FIG. 1 a reproduction system 10 with a printing system 12 having two integrated print engines 12A and 121B. The printing system 12 is being simultaneously fed print media sheets from two print media supply modules 20 and 30. That is, being fed sheets 22 from tray 24 by sheet separator/feeder 26 via path 28 in module 20 and also being fed sheets 32 from tray 34 by feeder 36 and path 38 in module 30. All of these components may desirably be identical. The sheets fed from both may be sequentially merged at a merger area 40 into a common path 42 to the printing system 12, feeding sheets thereto at twice the rate of the individual sheet feeders. If desired, the printing system 12 can have a gate system 43 as shown to select which sheets are fed to the plural print engines 12A, 12B in this example. All of these active components may be otherwise conventional and controlled by the conventional programmable controller 100.

Turning to the FIG. 2 embodiment, common components are commonly numbered. The single print engine 60 is being sequentially alternately fed print media sheet 22 and 32 from module 50 which can have both sheet trays 24 and 34 and their respective sheet separator/feeders 26 and 36. The individual output paths 28 and 29 of these two sheet feeders is merged at merger point 52 into a single sheet path 54, feeding sheets at twice the ppm rate of the two sheet feeders 26 and 36.

As previously described, normally to obtain a higher print/copy rate in a given printing system product, the normal practice to redesign the sheet separator/feeder to run at a correspondingly higher feed rate. However, this approach can result in a feeder with a significantly higher unit manufacturing cost if major changes are required to the feeder design, such as changing from an active retard feeder to a vacuum corrugated feeder. Also, higher feed rates can lead to increased jam rates as there is less time available for the feeder to perform its task.

The present embodiments feature a feeding algorithm which utilizes two or more feeders to achieve high print/copy rates while allowing the use of relatively inexpensive sheet separator/feeder technologies. For example, in the case of a 120 ppm printing system, two 60 ppm feeders may be used in parallel to achieve the 120 ppm feed rate. Both of feeders are run simultaneously, and a paper path controller is used to ensure that the sheets from these feeders are interleaved as they merge into the main paper path. They may be registered later. The method of control may be as simple as a "feed" signal sent at the appropriate time to each sheet feeder, with the transport velocity of each feeder set equal to about 1.5 times the process velocity of the printing system, for example. This relatively high initial sheet transport velocity from each sheet feeder will create gaps (spaces) between the sheets fed from each individual feeder large enough to allow interleaving when the two sheet streams are combined (merged) into one sheet stream before entering the registration area, as described in the above examples.

This can even utilize existing media path technology to significantly increase the possible sheet feed rate for a printing system, which has more than one sheet feeder available. It is well known that cut-sheet feeder technology complexity and cost increases substantially as the demanded feed rate increases, especially when coated paper is used, for reasons noted above. Another factor driving up the cost is the amount of energy required to successfully acquire and feed sheets more rapidly from a stack into the media path. In terms of vacuum corrugated feeder technology for example, this relates to the higher pressures and flow rates needed to feed cut-sheet paper at high speed.

If, as here, more than one sheet feeder can be used for a given print job, the required feed rate of each feeder used may be a fraction of the overall feed rate. For example, if two feeders were used to support a 120 ppm feed rate, each feeder would only need to operate at 60 ppm. Depending upon the application, the lower feed rate required of each feeder could allow the use of a less expensive feeder design which would consume less power and produce less noise.

Referring further to the FIG. 1 example, this illustrates one possible dual-feeder configuration in which two high capacity feeder modules are connected in series. Each feeder module operated by its own controller, which in turn may operate according to commands sent by the overall system controller. The media transports and the sheet feeder are designed to operate at a transport velocity set by the desired overall sheet feed rate, but with the actual feed cycle time of each feeder being set at a value corresponding to half of the overall sheet feed rate. Using a conventional timing diagram, which reflects the media path geometry, the system controller may send feed commands to the feeders such that the two paper streams interleave smoothly into one paper stream. If necessary, a closed loop control could be implemented by first measuring the arrival times at the paper stream merger area and then adjusting the feed command timing to assure a consistent inter-copy gap between the sheets in the merged paper stream. The second option depicted in FIG. 2 may utilize the same theory of operation, the difference being the fact that both feeders are contained in one feeder module.

It should be recognized that this concept is not limited to any particular feeder technologies. It could apply to either vacuum corrugating feeders or active or semi-active retard feeders. In a TIPP integrated multiple print engine system, the requisite high print media throughput rates could be achieved by running multiple retard feeders in parallel.

Another advantage is that since each sheet feeder may be operating at a fraction of the overall sheet feed rate, less feeder development time may be required. Existing feeder technology may be used for non-coated paper. For coated paper print media it is far easier to develop an inexpensive feeder to feed at 60 sheet feeds per minute than it is to develop a feeder which can accommodate feed rates up to 200 feeds per minute and beyond. This is due in part to the significantly higher amount of effort (or energy) required for a single feeder to successfully acquire and separate coated papers at high speed. Once a 60 ppm feeder has been developed and optimized both for performance and cost, the same feeder design can be used via the subject parallel feeding algorithm to support much higher print rates (i.e., two feeders will give an overall feed rate of 120 ppm, three feeders will give an overall feed rate of 180 ppm, etc.)

Implementing a parallel feeding approach allows a smaller number of different feeder designs, which could then be optimized for cost and increased production volume advantages as well as performance, and shorten the development and production time for new products.

In a very high media throughput of an integrated multiple printers platform (e.g., 300+ ppm), this parallel feeder approach can either be applied in a traditional left-hand side feeder module as in FIGS. 1 and 2, or in feeder modules placed at strategic locations inside of the printing system, in between print engines.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A marking machine comprising a printing system, said printing system comprising a predetermined printing rate and an operably integrated sheets feeding system for unprinted media sheets, said operably integrated sheets feeding system feeding said unprinted media sheets to said printing system at said pre-determined printing rate of said printing system from at least two separate sheet feeders feeding from at least two separate stacks of said unprinted media sheets, said at least two separate sheet feeders are controlled by a system controller programmed with a sheet feeding algorithm to alternately feed said unprinted media sheets to said printing system from said at least two separate sheet feeders into at least two separate fed sheets streams at a sheet feeding rate of approximately one-half or less of said printing system printing rate from each of said at least two separate sheet feeders, wherein a sheet merging position is provided for merging said at least two separate fed sheet streams, and wherein said system controller sheet feeding algorithm is enabled to send sheet feeding commands to said at least two sheet feeders at programmed times such that said at least two separate sheet feeders feed sheets into said respective said at least two fed sheet streams at times which allow said at least two fed sheet streams to interleave into a single fed sheet stream (54) at said predetermined printing rate of said printing system feeding sheets at twice the ppm rate of the at least two separate sheet feeders (26 and 36), and wherein said sheet merging position is between said at least two separate sheet feeders and said printing system.

* * * * *